United States Patent [19]

Kajiwara et al.

[11] Patent Number: 4,661,441

[45] Date of Patent: Apr. 28, 1987

[54] LIGHT-SENSITIVE SILVER HALIDE PHOTOGRAPHIC MATERIAL

[75] Inventors: Makoto Kajiwara; Kaoru Onodera, both of Odawara, Japan

[73] Assignee: Konishiroku Photo Industry Co., Ltd., Tokyo, Japan

[21] Appl. No.: 721,569

[22] Filed: Apr. 10, 1985

[30] Foreign Application Priority Data

Apr. 20, 1984 [JP] Japan ..... 59-80593

[51] Int. Cl.[4] ..... G03C 1/30

[52] U.S. Cl. ..... 430/555; 430/626; 430/567

[58] Field of Search ..... 430/626, 567, 555

[56] References Cited

U.S. PATENT DOCUMENTS

| | | | |
|---|---|---|---|
| 3,325,287 | 6/1967 | Yamamoto et al. | 430/626 |
| 3,684,514 | 8/1972 | Iwama et al. | 430/554 |
| 3,701,664 | 10/1972 | Piller et al. | 430/626 |
| 3,885,970 | 5/1975 | Miyahara | 430/567 |
| 4,446,228 | 5/1984 | Honda et al. | 430/567 |

*Primary Examiner*—Won H. Louie

*Attorney, Agent, or Firm*—Frishauf, Holtz, Goodman & Woodward

[57] ABSTRACT

Disclosed is a silver halide photographic material containing at least one layer of silver halide emulsion layers on a support characterized in that at least one layer of said silver halide emulsion layers contains mono-dispersed silver halide grains formed with (100) face and (111) face and said silver halide emulsion layer is hardened with at least one of the hardening agents represented by the formula [I] shown below and/or at least one of the hardening agents represented by the formula [II] shown below,

[I]

wherein $R_1$ represents a chlorine atom, a hydroxy group, an alkyl group, an alkoxy group, an alkylthio group, —OM group (M is a monovalent metal atom), —NR'R" (R' and R" are a hydrogen atom, an alkyl group or an aryl group, respectively) or —NHCOR'" (R'" is a hydrogen atom, an alkyl group or an aryl group) and $R_2$ has the same meanings as $R_1$ except for a chlorine atom,

[II]

wherein $R_3$, $R_3'$, $R_4$ and $R_4'$ each represent a chlorine atom, a hydroxy group, an alkyl group, an alkoxy group or a —OM group (M is a monovalent metal atom); Q and Q' each represent a binding group of —O—, —S— or —NH—; L represents an alkylene group or an arylene group; and p and q represent 0 or 1.

18 Claims, No Drawings

LIGHT-SENSITIVE SILVER HALIDE PHOTOGRAPHIC MATERIAL

BACKGROUND OF THE INVENTION

This invention relates to an improvement in a light-sensitive silver halide photographic material and, more particularly, it is concerned with a light-sensitive silver halide photographic material which has a high sensitivity and a favorable gradation, shows a superior pressure resistance and stability with the lapse of time as a light-sensitive material and is suitable for a low replenishing type process.

Recently, a high speed developing process for a light-sensitive silver halide photographic material (hereinafter referred to simply as a light-sensitive material) has been carried forward and, moreover, reduction in a volume of a replenishing solution has been increased with concentration of a replenishing developing solution for improved working efficiency and reduced cost; the so-called low replenishing type developing solution has been used. In reply to the trend in this field, there has been much need for a light-sensitive silver halide photographic material having a rapid processibility and a low replenishing type aptitude. However, a halogen ion has been accumulated at a higher concentration in a low replenishing type developing solution, as compared with the prior type developing solution.

In general, a halogen ion has a development retarding effect and an iodine ion shows a particularly strong effect and a bromine ion and a chlorine ion show said effect in order, a retarding power of chlorine ion being very weak in comparison with the other two ions. Therefore, studies have been made for meeting the said need by using a silver chlorobromide emulsion having a relatively high chlorine content, but the higher the silver chloride content becomes, the lower is the sensitivity. Further, there has been presented a problem of increased fogging when a light-sensitive material is stored with time. A high sensitizing technique has been required to compensate for said reduced sensitivity.

Also, there has been taught a high sensitization using a mono-dispersed emulsion, among studies on sensitization techniques approached from various aspects.

For instance, there has been reported studies to theoretically calculate quantum efficiency of a silver halide and investigate influence of grain size distribution in a preliminary summary for 1980 Tokyo Symposium about progress of photography, "Interactions between light and materials for photographic applications", page 91. According to this study, it is taught that a mono-dispersed emulsion is effective for improving quantum efficiency, namely, for possible high sensitization. In addition, a mono-dispersed emulsion having a unifor crystal habit and a narrow distribution of grain size is considered to advantageously reach a high sensitivity effectively, while fogging is kept lower, even during chemical sensitization; and thus a light-sensitive material design has been recently attempted using a mono-dispersed emulsion. However, a mono-dispersed emulsion shows too much contrast in gradation because of its property having a very narrow grain size distribution and, particularly, is difficult to be used as a light-sensitive material commonly employed for negative-positive printing.

More specifically, it is desirable for improving such performance as high sensitization etc. to improve mono-dispersability of a silver halide emulsion; but there is an inconsistent relationship, namely, the produced silver halide emulsion, on the other hand, has become more difficult to be applied in regard to gradation, as mono-dispersability has been improved.

For improving this drawback, there has been proposed a method wherein 2 or more sorts of mono-dispersed emulsions are mixed to obtain a favourable gradation, as disclosed, for example, in Japanese Patent Publication No. 56054/1982 and Japanese Provisional Patent Publications No. 58137/1982 and No. 14829/1983. However, it is necessary in this method that 2 or more sorts of different emulsions should be prepared in order to produce one sort of emulsion eventually and step numbers are increased during production, which leads to increase in production cost, so that this method could not be regarded as preferable.

Further, soft gradation has been attempted by reducing an amount of coated silver or coupler for control of gradation; but this method may produce a highly decreased density in a high density portion of image and thus could not form a satisfactory image.

As stated above, a mono-dispersed emulsion composed of silver chlorobromide grains with a relatively high chlorine content may have a high sensitivity, a superior rapid processability and a superior aptitude for a low replenishing type developing solution; but it produces too hard gradation and also has a practically fatal problem of increased fogging from storage of a light-sensitive material with the lapse of time.

SUMMARY OF THE INVENTION

An object of this invention is to provide a light-sensitive material which has a high sensitivity and aptitude for rapid processing, as well as diminish increase or rise in fogging from storage with the lapse of time, a favourable gradation and an improved resistance to pressure.

The aforesaid object of this invention can be accomplished with a light-sensitive silver halide photographic material containing at least one layer of silver halide emulsion layers on a support characterized in that at least one layer of said silver halide emulsion layers contains mono-dispersed silver halide grains formed with (100) face and (111) face and said silver halide emulsion layer is hardened with at least one of the hardening agents represented by the under-mentioned general formula [I] and/or at least one of the hardening agents represented by the general formula [II].

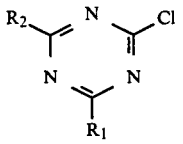

[I]

wherein $R_1$ represents a chlorine atom, a hydroxy group, an alkyl group, an alkoxy group, an alkylthio group, —OM group (M is a monovalent metal atom), —NR'R" (R' and R" represent a hydrogen atom, an alkyl group or an aryl group, respectively), —NHCOR''' (R''' is a hydrogen atom, an alkyl group or an aryl group) and $R_2$ is the same meanings as $R_1$ except for a chlorine atom,

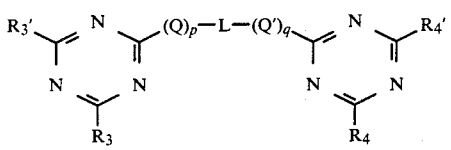

[II]

wherein $R_3$, $R_3'$, $R_4$ and $R_4'$ each represent a chlorine atom, a hydroxy group, an alkyl group, an alkoxy group or —OM group (M is a monovalent metal atom); Q and Q' each represent a binding group of —O—, —S— or —NH—; L represents an alkylene group or an arylene group; and p and q each represent 0 or 1.

DESCRIPTION OF THE PREFERRED EMBODIMENTS

As an embodiment of this invention, it is preferred that the mono-dispersed silver halide grain is substantially silver chlorobromoiodide or silver chlorobromide containing not less than 5 mole % of a silver chloride and less than 1 mole % of a silver iodide content in a silver halide composition of said mono-dispersed silver halide grain.

The mono-dispersed emulsion as used herein is meant to indicate an emulsions which, when a grain size distribution of silver halide grains constituting said emulsions is measured, its coefficient of variation is not more than 22%, preferably 15% or less. The coefficient of variation is a coefficient indicating a grain size distribution width and can be defined by the following formula.

$$\text{Coefficient of variation} = \frac{\text{Standard deviation of grain diameter}}{\text{Average grain diameter}} \times 100(\%)$$

A grain size distribution can be measured by analysis of electron microscopic photograph, but it is convenient for grains having different grain shapes as seen in this invention to analyze measured data taken by such instruments as Coulter counter (manufactured by Coulter Electronics, Inc.) and the like.

Further, crystal face of a silver halide grain is defined by using a diffraction peak intensity ratio of (200) face corresponding to (100) face and (222) face corresponding to (111) face according to the powder X-ray diffraction analysis disclosed in Japanese Provisional Patent Publication No. 29243/1984 and "Bulletin of the Society of Scientific Photography of Japan, No. 13, Dec., 1963", namely, $$K = \frac{\text{Intensity of diffracted ray attributable to (200) face}}{\text{Intensity of diffracted ray attributable to (222) face}}$$

The mono-dispersed silver halide grain of this invention is to indicate a silver halide grain falling within a range of $3 \leqq K \leqq 500$, preferably $10 \leqq K \leqq 400$, more preferably $40 \leqq K \leqq 200$.

In this invention, it is preferred that the grain of the silver halide emulsion is a normal crystal grain.

The mono-dispersed silver halide grain in this invention is preferably a tetradecahedral grain and its use results from consideration of resistance to pressure effect. Where a silver halide grain is subjected to outside pressure, fogging tends to be produced or unusual sensitization or desensitization may occur at that place. Susceptibility to such a pressure effect may vary depending upon the state of a light-sensitive material when pressure applied, but it may be most easily produced when pressure is applied to a light-sensitive material under wet condition as in a developing solution. In this instance, fogging may be produced at the place where pressure applied and quality of the light-sensitive material would be greatly lowered. The present silver halide grain shows a superior pressure resistance when wetted, as compared with octahedral or cubic silver halide grains. In particular, superiority may be remarkably enhanced in the layer of which is hardened by the hardener represented by the general formula [I] or [II] in this invention.

The present silver halide emulsion may be incorporated with other silver halide grain than the present one to the extent that effects by the present invention would not be adversely affected. So, a mixed proportion of different shaped grains is, for instance, preferably not more than 20%, more preferably not more than 10%.

The mono-dispersed silver halide emulsion of the present invention comprises not more than 1 mole % silver iodide and the remainder of silver chloride and silver bromide in a silver halide composition of a silver halide grain. It is preferred that a mono-dispersed emulsion comprises substantially silver halide grains with a silver chloride content of not less than 5 mole % in a silver halide grain, more preferably not less than 15 mole %, most preferably a mono-dispersed emulsion comprising silver halide grains with a silver chloride content of not less than 25 mole % in a silver halide grain.

Grain diameter of the silver halide grain to be included in the silver halide emulsion of the present invention is preferably of approximately 0.2–2.0 μm, more preferably 0.3–1.2 μm.

The silver halide grain of the present invention may be any of those prepared according to a neutralization method, an acidification method or an ammonia method. Also, there may be preferably employed for improved mono-dispersed emulsion a pAg-controlled-double jet method as disclosed in Japanese Provisional Patent Publication No. 48521/1979 and so on. More specifically, the mono-dispersed emulsion of the present invention can be prepared by the following method.

Namely, in the method of preparing silver bromide and silver iodobromide crystals for light-sensitive photographic material by simultaneously adding a silver salt aqueous solution and a halide salt aqueous solution in the presence of a protective colloid and reacting (double jet method) them to grow up seed crystals, it can be prepared by a method of adding each of the above two kinds of aqueous solutions at an addition speed of from Q (mole/min) represented by the following formula to not less than 50% of said addition speed Q.

$$Q = \left\{ \left( \frac{\bar{x} + y}{\bar{x}} \right)^3 - 1 \right\} \times (m_0 + m)$$

wherein $\bar{x}$ is a grain size of growing up crystals (μm), $m_0$ is an amount (mole) of seed crystals initially added, m is a total amount (mole) of an added silver salt aqueous solution, and y is represented by the following formula:

$$y = 10^{\{fa(I) + fb(pAg) + fc(CNH3) + fd(r,x)\}}$$

-continued wherein $fa(I) = a_0 + a_1 I$, $$fb(pAg) = b_0 + b_1(pAg) + b_2(pAg)^2 + b_3(pAg)^3 + b_4(pAg)^4 + b_5(pAg)^5,$$

$$fc(CNH_3) = \frac{c_1}{CNH_3 + c_0} + c_2,$$

$$fd(r,x) = d_0 + d_1(r - \bar{x} + 0.5) + d_2(r - \bar{x} + 0.5)^2 + d_3 \log \bar{x}.$$

In the above formulae, I represents iodine content of silver iodobromide (mole percent), pAg represents a logarithm of a silver ion concentration in the reaction solution, $CNH_3$ represents a concentration of ammonia (mole/l) in the reaction solution, and r represents an average distance (μm) between grains of growing crystals. Further, $a_0$, $a_1$, $b_0$, $b_1$, $b_2$, $b_3$, $b_4$, $b_5$, $c_0$, $c_1$, $c_2$, $d_0$, $d_1$, $d_2$, and $d_3$ are numerals shown in the following table.

| | |
|---|---|
| $a_0$ | +0.07938 |
| $a_1$ | −0.01323 |
| $b_0$ | +4178.9825 |
| $b_1$ | −2831.27994 |
| $b_2$ | +762.55901 |
| $b_3$ | −102.086248 |
| $b_4$ | +6.7915594 |
| $b_5$ | −0.1795947 |
| $c_0$ | +0.15 |
| $c_1$ | −0.2146 |
| $c_2$ | +1.4307 |
| $d_0$ | +0.6342 |
| $d_1$ | −0.4590 |
| $d_2$ | +0.04765 |
| $d_3$ | −0.5669 |

However, one may of course utilize a conventional double jet method.

Also, if necessary, a silver halide solvent such as a thioether and the like or a crystal habit controlling agent such as a mercapto group-containing compound or a sensitizing dye may be employed.

In preparing the silver halide grain of the present invention, there may be also incorporated a platinum group element such as iridium or rhodium. It is particularly preferred to add iridium at $1\times10^{-8}$ to $1\times10^{-5}$ mole per mole of silver halide.

Illustrative examples of the compounds [I] and [II] which may be employed in this invention are recited below, but there are not restricted thereto solely.

Compounds represented by the general formula [I]

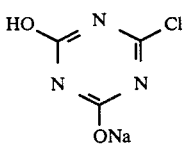
(I-1)

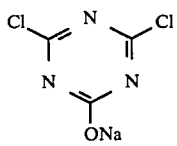
(I-2)

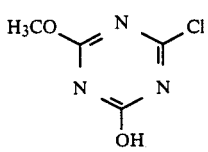
(I-3)

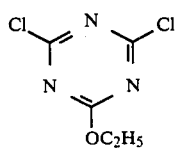
(I-4)

-continued

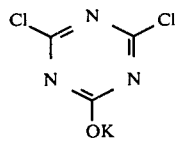
(I-5)

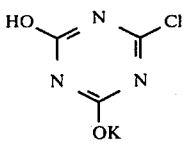
(I-6)

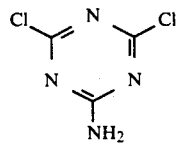
(I-7)

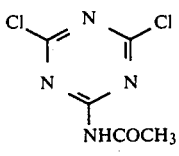
(I-8)

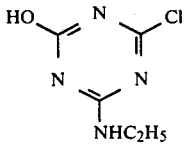
(I-9)

Compounds represented by the general formula [II]:

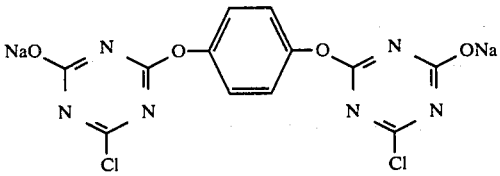
(II-1)

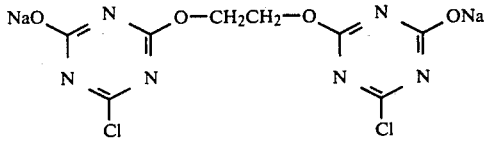
(II-2)

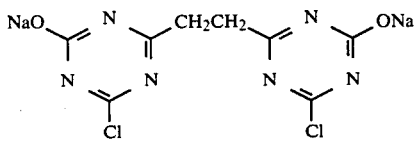
(II-3)

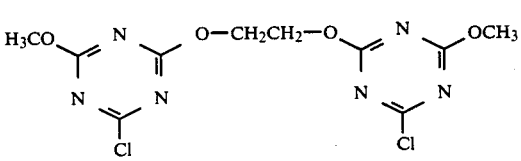
(II-4)

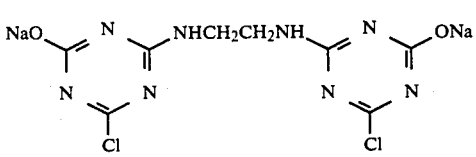
(II-5)

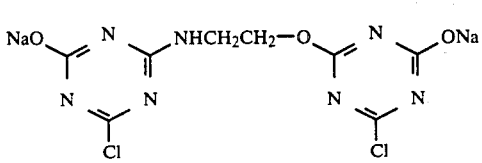
(II-6)

-continued (II-7)

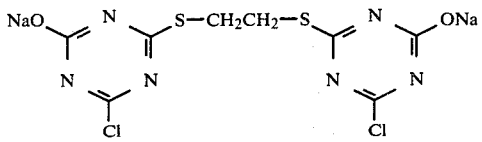

(II-8)

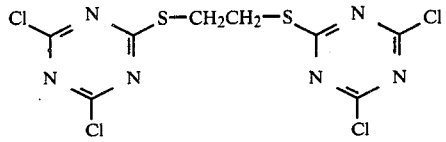

(II-9)

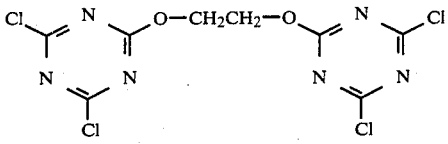

The compound to be used in the present invention represented by the above-mentioned general formula [I] or [II] may be incorporated into at least one layer or plural layers selected from the present emulsion layers or auxiliary layers in order to affect hardening. Incorporation may be carried out by dissolving in water or an alcohol (e.g., methyl alcohol, ethyl alcohol etc.) and then using a batchwise method, an in-line method or the like. An amount thereof to be incorporated is not particularly critical to a silver halide, but there may be used 1–100 mg, preferably 5–50 mg, per gram of gelatin, in order to develop a useful hardening effect.

Also, a hardening agent of this invention represented by the above-mentioned general formula [I] or [II], even if added in the range of such an amount thereof to be incorporated that a sufficient hardening effect could not be developed, is regarded as falling within the purview of this invention.

A silver halide emulsion in this invention may be chemically sensitized with a sulfur sensitizer (e.g., sodium thiosulfate, thiourea, allylthiourea, etc.), a selenium sensitizer, a reduction sensitizer (e.g., a stannous salt, a polyamine, etc.), a noble metal sensitizer (e.g., a gold sensitizer, illustratively, sodium chloroaurate, potassium aurothiocyanate, etc.) alone or in a proper combination therewith.

Moreover, the silver halide emulsion may be optically sensitized to the desired wave length range. Optical sensitization may be effected, for example, with optical sensitizers such as a cyanine dye, e.g. zeromethine dye, monomethine dye, dimethine dye, trimethine dye, etc. or a merocyanine dye and the like alone or in combination therewith.

A silver halide emulsion layer which may be employed in this invention may include those compounds commonly employable in a light-sensitive material as shown below.

As the stabilizer or fog restrainer, there may be used the stabilizer or fog restrainer as disclosed in U.S. Pat. No. 2,444,607, No. 2,716,062, No. 3,512,982 and No. 3,342,596; West German Pat. No. 11 89 380 and No. 20 58 626; Japanese Patent Publications No. 4133/1968 and No. 2825/1964; and Japanese Provisional Patent Publications No. 22626/1975, No. 25218/1975 and No. 133954/1978, etc.

As examples of the surface active agents, there may be used saponin, sodium dodecylbenzenesulfonate, sodium sulfosuccinate, as well as those as disclosed in Japanese Provisional Patent Publications No. 46733/1974, No. 10722/1974 and No. 16525/1975, etc.

As the binder which may be employed in this invention, there may be mentioned gelatin, colloidal albumin, agar, gum arabic, alginic acid, hydrolyzed cellulose acetate, acrylamide, imidated polyamide, polyvinyl alcohol, hydrolyzed polyvinyl acetate or water-soluble polymers as disclosed, for example, in British Pat. No. 523,611, West German Pat. No. 22 55 711 and No. 20 46 682, U.S. Pat. No. 3,341,332 and so on and gelatin may be frequently employed among them.

These hydrophilic colloids may be applied not only in an emulsion layer but similarly in layers containing no silver halide such as auxiliary layers, e.g., a filter layer, a protective layer, an intermediate layer, etc.

Where the present silver halide emulsion is to be applied to a color light-sensitive material, there may be employed as a coupler a wide variety of compounds; for instance, an open-chain ketomethylene type coupler may be used as a yellow coupler, particularly a pivaloylacetanilide type compound is useful. As a magenta coupler, there may be used pyrazoline-, pyrazolotriazole-, pyrazolinebenzimidazole- or indazolone-type compounds, particularly pyrazolone type compounds are useful. Also, as a cyan coupler, there may be used phenol- or naphthol-type compounds. Such a coupler may be either a two equivalent-type coupler or a four equivalent-type coupler. Moreover, there may be used a colored magenta coupler, a colored cyan coupler or a DIR coupler, a BAR coupler, a Weiss coupler, a competing coupler and the like in this photographic emulsion. Further, as an ultraviolet absorbing agent, there may be used, for example, benzotriazole compounds, thiazolidone compounds, acrylonitrile compounds, benzophenone compounds and the like. If necessary, there may be also used an antistatic agent, a fluorescent intensifying agent, an antioxidant, a stain retarder and so on.

Where the present invention is to be applied to a color photographic material, it is particularly preferred to employ a coupler represented by the under-mentioned formula [III] as a magenta coupler.

[III]

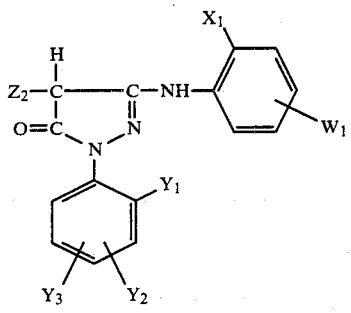

(in the above general formula [III], $X_1$ represents a hydrogen atom, a halogen atom, an alkyl group, an alkoxy group, an aryloxy group, an amido group, a hydroxy group, a cyano group or a nitro group; $Y_1$, $Y_2$ and $Y_3$ individually represent a hydrogen atom, a halogen atom, an alkyl group, an alkoxy group, a carboxy group, an alkoxycarbonyl group, a nitro group, an aryloxy group, a cyano group or an acylamino group; $W_1$ represents a hydrogen atom, a halogen atom or a monovalent organic group; and $Z_2$ represents atoms or groups which are removable by coupling reaction).

The above-mentioned general formula [III] will be more fully illustrated below; $W_1$ represents a hydrogen atom, a halogen atom or a monovalent organic group and, as the monovalent organic group, there may be preferably mentioned a nitro group, an alkyl group, an alkoxy group, an acylamino group, a sulfonamido group, the followings being optionally substituted respectively, an alkylcarbamoyl group, an arylcarbamoyl group, an alkylsulfamoyl group, an arylsulfamoyl group, an alkylsuccinimido group, an alkoxycarboamido group, an alkoxycarboalkylamino group, an aralkoxycarboalkylamino group, an alkylaminocarboalkylamino group, an arylaminocarboalkylamino group, an aralkylaminocarboalkylamino group and the like.

Also, $Z_2$ may be any of well-known atoms or groups which may be removed with coupling.

Then, representative examples of the magenta coupler represented by the general fomrula [III] are given below.

M-1

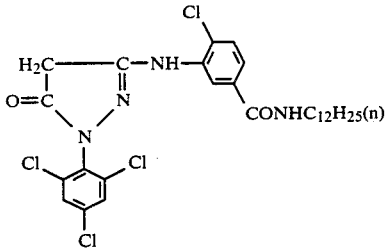

M-2

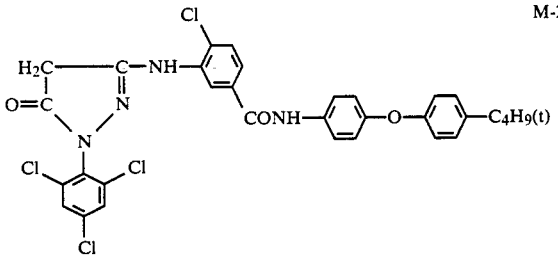

M-3

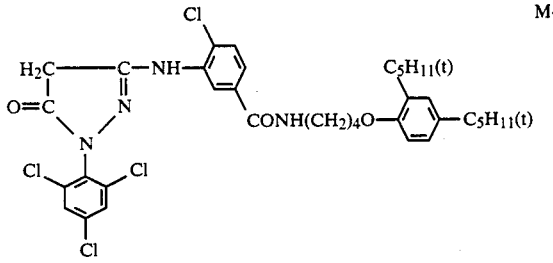

M-4

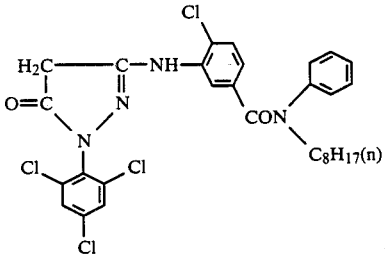

-continued

M-5

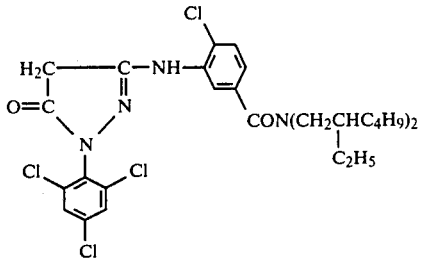

M-6

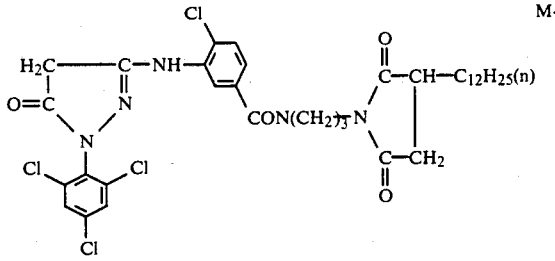

M-7

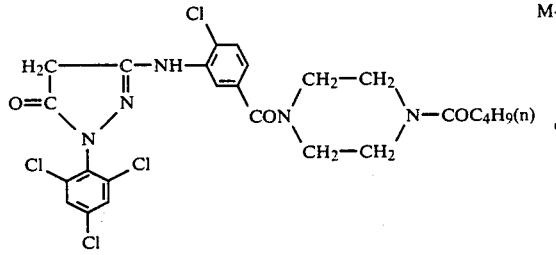

M-8

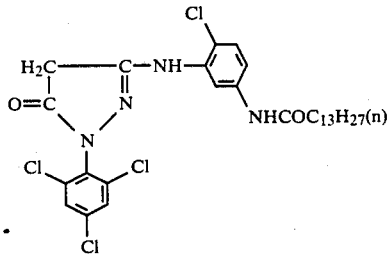

M-9

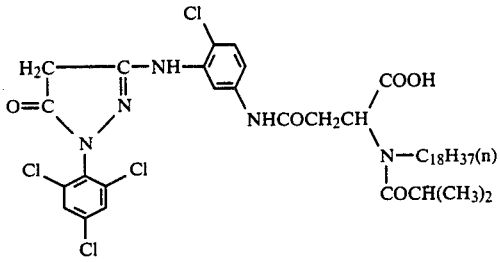

M-10

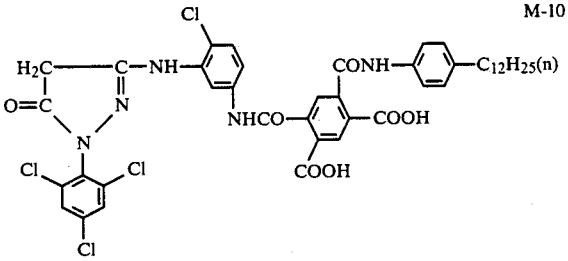

-continued
M-11
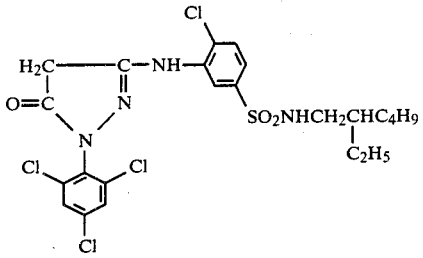
M-12
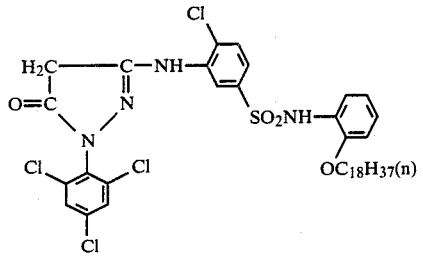
M-13
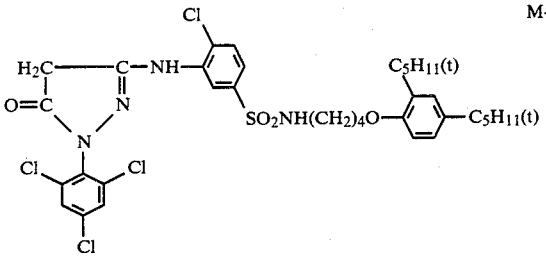
M-14
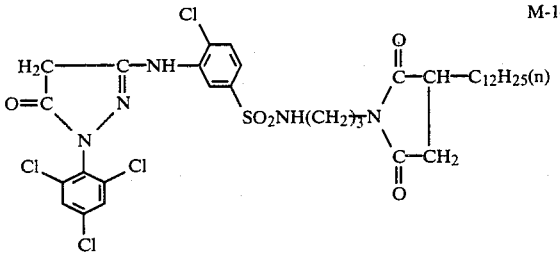
M-15
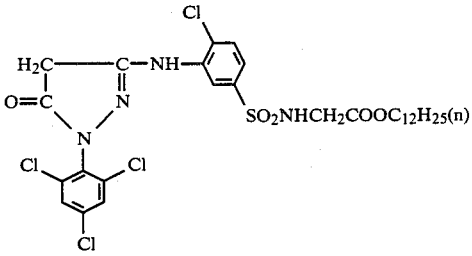
M-16
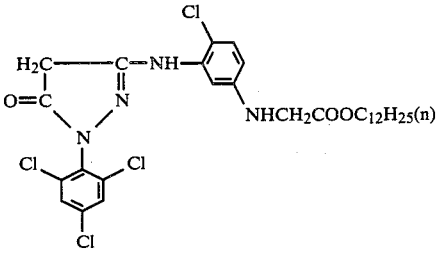
-continued
M-17
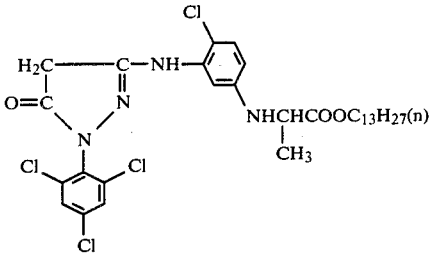
M-18
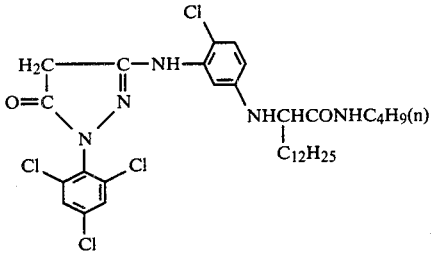
M-19
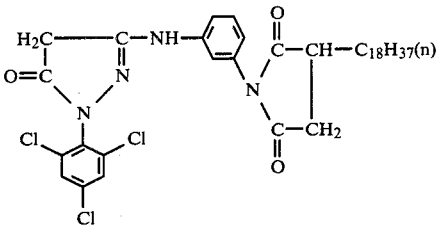
M-20
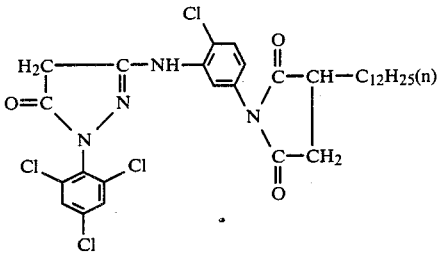
M-21
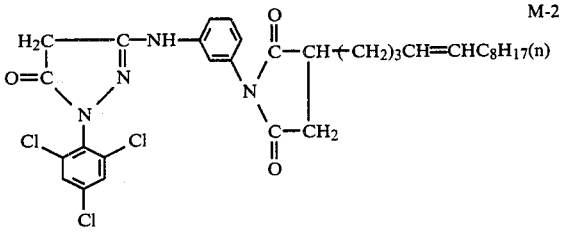
M-22
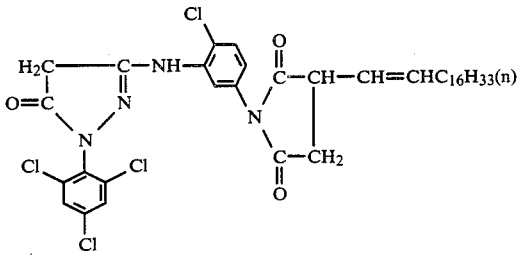

-continued
M-23
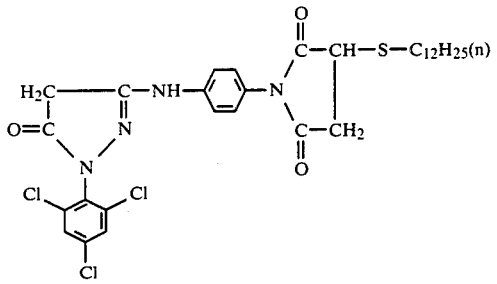
M-24
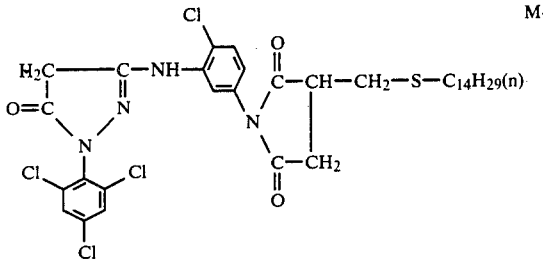
M-25
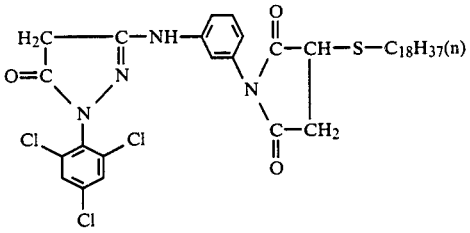
M-26
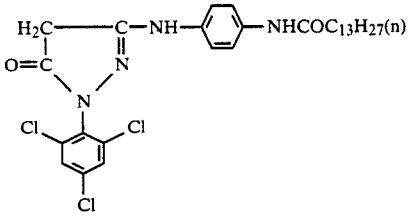
M-27
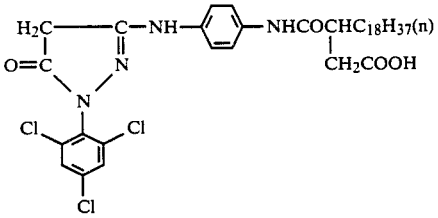
M-28
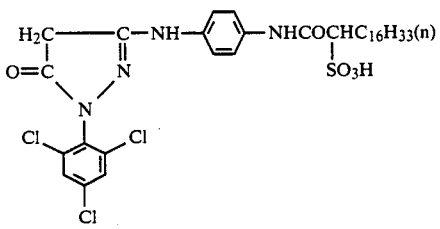
-continued
M-29
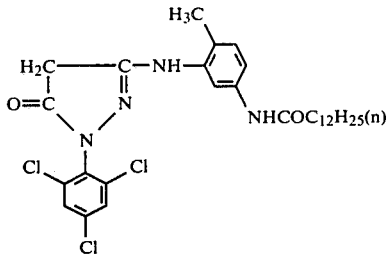
M-30
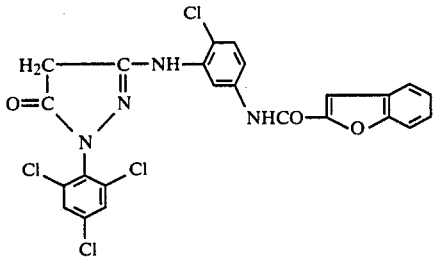
M-31
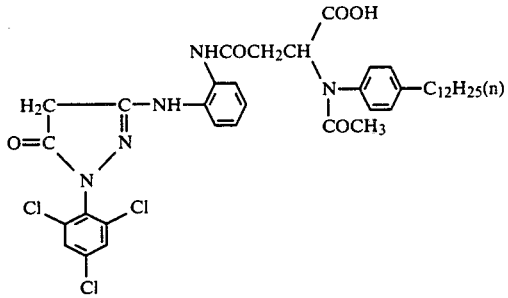
M-32
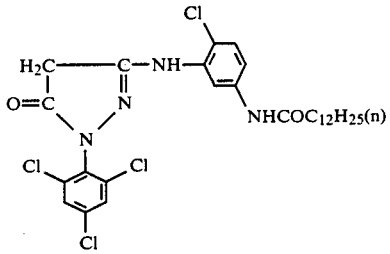
M-33
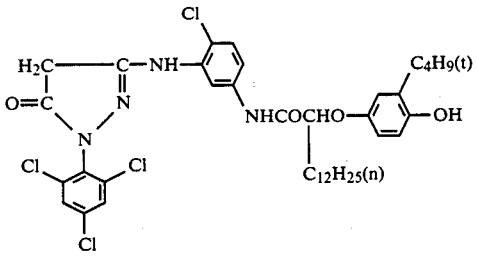
M-34
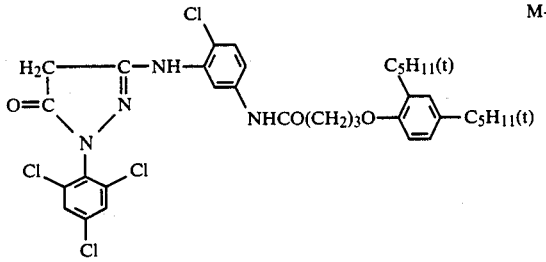

-continued

M-35

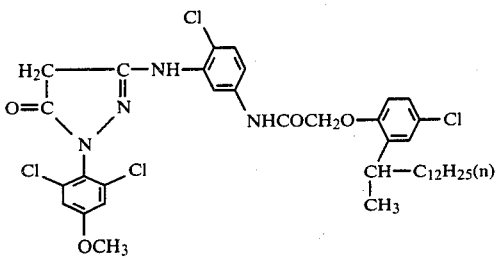

M-36

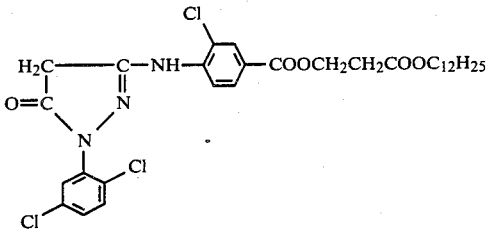

M-37

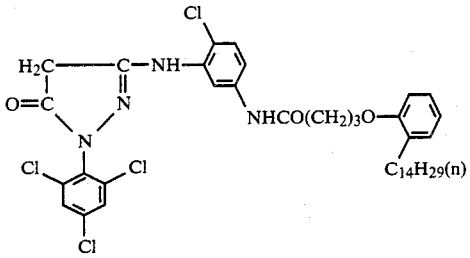

M-38

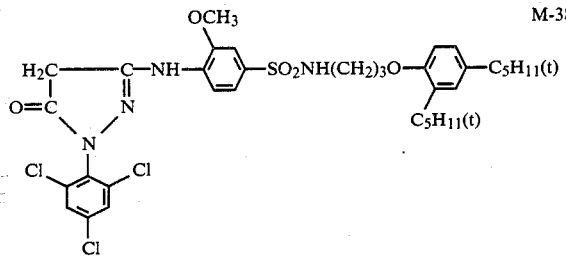

M-39

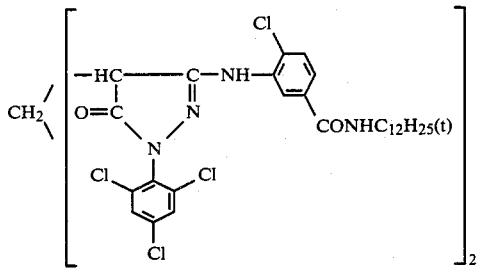

M-40

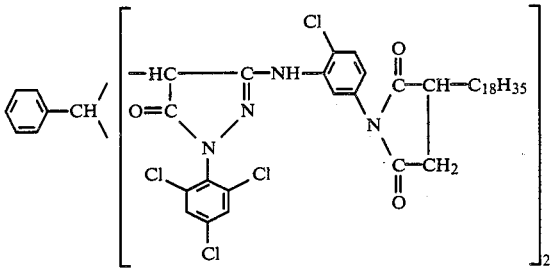

-continued

M-41

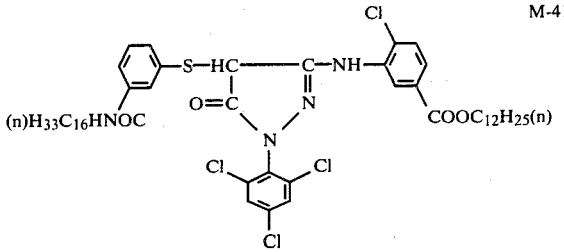

M-42

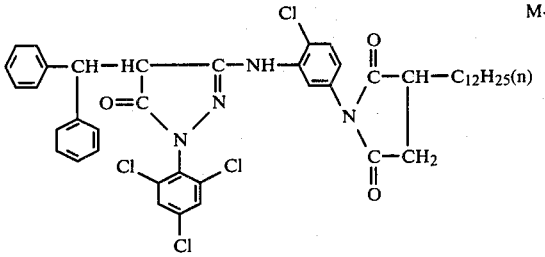

M-43

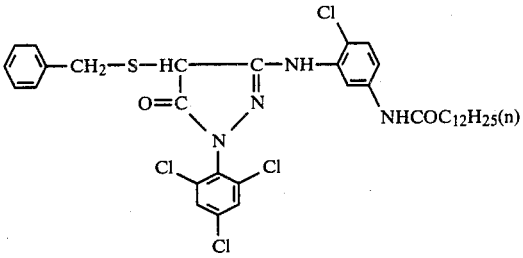

M-44

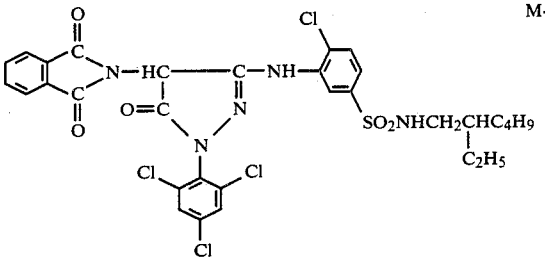

M-45

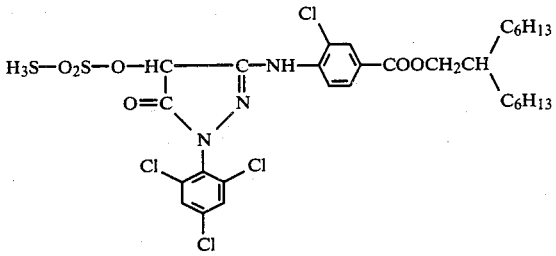

These magenta couplers may be synthesized according to processes as disclosed in, for example, U.S. Pat. No. 3,684,514; British Pat. No. 1,183,515; Japanese Patent Publication No. 6031/1965, No. 6035/1965, No. 15754/1969, No. 40757/1970 and No. 19032/1971; and Japanese Provisional Patent Publications No. 13041/1975, No. 129035/1978, No. 37646/1976 and No. 62454/1980.

As the support which may be employed in this invention, there may be used a support such as a paper, a glass, cellulose acetate, cellulose nitrate, a polyester, a polyamide, a polystyrene, and the like or a bonded laminate of two or more substrates such as a laminate of paper with a polyolefin (e.g., polyethylene, polypropylene, etc.). And, the support may be generally subjected to various processings for surface improvement, in order to improve adhesive property to a silver halide emulsion; for instance, there may be employed those supports to which surface processing, e.g., electron bombardment processing is applied or subbing processing with a subbing layer is applied.

For coating and drying a silver halide photographic emulsion onto the support, coating may be effected by conventionally known processes such as dip coating, roller coating, beat coating, curtain flow coating and the like followed by drying.

The light-sensitive material of the present invention may be developed according to conventional black and white development or color development.

As the color developing agent useful for color development, there may be mentioned, for example, an aromatic primary amine compound such as N,N-diethyl-p-phenylenediamine, N,N-ethyl-N-hydroxyethyl-p-phenylenediamine, 4-(N-ethyl-N-hydroxyethylamino-2-methylaniline, 4-(N-ethyl-N-β-methanesulfonamidoethyl)amino-2-methylaniline, 4-(N,N-diethyl)amino-2-methylaniline, 4-(N-ethyl-N-methoxyethyl)amino-2-methylaniline and corresponding sulfate, hydrochloride, sulfite, p-toluenesulfonate and the like.

After color development, bleach-fixing is effected. As preferable bleaching agent for developed silver, there may be mentioned an organic acid polyvalent metal salt, one example of which is a organic acid ferric salt. Illustrative examples thereof may include ferric salts of nitrilotriacetic acid, diethylenetriamine pentaacetic acid, ethylene glycol bis(aminoethyl ether)tetraacetic acid, diaminopropanol tetraacetic acid, N-(2-hydroxyethyl)ethylenediaminetriacetic acid, ethyliminodipropionic acid, cyclohexanediamine tetraacetic acid, ethylenediaminetetraacetic acid and the like. Also, there may be utilized a polycarboxylic acid ferric salt such as ferric salts of oxalic acid, malonic acid, succinic acid, tartaric acid, malic acid, citric acid or salicylic acid. As the polyvalent metal, there may be also used cupric salts or cobalt (II) salts in addition to the abovementioned ferric salts. Further, there may be also employed inorganic polyvalent metal salts such as ferric chloride, ferric sulfate and the like, depending upon the purposes. Also, as the fixing agent, there may be included thiosulfates, thiocyanates and the like which are previously known, as well as water-soluble alkali metal salts, e.g., potassium bromide, ammonium bromide, sodium iodide as disclosed in Japanese Provisional Patent Publication No. 101934/1973 or ammonium bromide or ammonium iodide.

Moreover, respective processings such as pre-hardening, neutralizing, washing, stabilizing and so on may be applied, in combination with color development and bleach-fixing.

EXAMPLES

This invention will be explained concretely by way of the following examples, but this invention is not limited thereto.

EXAMPLE 1

Silver chlorobromide emulsions of Em-1 and Em-2 were prepared under the following conditions according to a double jet method under neutral condition.

Em-1: Grain growth was carried out by controlling amounts of the silver ion-containing solution to be added and halide ion-containing solution to be added at 55° C., while maintaining pAg at 7.5 and pH at 6.0 constantly.

Em-2: Grain growth was carried out at 55° C. without controlling pAg, pH and amounts to be added.

During grain growth of Em-1 or Em-2, $K_2(IrCl_3)$ was added at $1\times10^{-6}$ mole per mole of silver halide when 60% of a total amount of the silver ion to be added was incorporated.

After completion of the growth, desalting and washing were conducted in a conventional manner. A silver halide composition of silver halide grains involved in the resultant 2 types of emulsions was 30 mole % of silver chloride and 70 mole % of silver bromide in both Em-1 and Em-2. The Em-1 was an emulsion composed of mono-dispersed tetradecahedral grains with a coefficient of variation of 11% and K=83, while the Em-2 was an emulsion composed of irregular-shaped twin crystal grains with a coefficient of variation of 27%.

Then, each emulsion was sulfur-sensitized in the presence of the following green-sensitive dye (A). After completion of the sulfur sensitization, 4-hydroxy-6-methyl-1,3,3,a,7-tetrazaindene was added to the emulsion, which was dissolved in dibutyl phthalate. The following magenta coupler (B) was added thereto at 0.2 mole per mole of silver halide together with the above-illustrated compound or comparative compound shown below and, thereafter, the resulting mixture was coated onto a resin-coated paper so that an amount of the coated silver was 3.5 mg/dm² and an amount of the coated gelatin was 10 mg/dm² and then dried to prepare Samples No. 1–No. 7.

Sensitizing dye (A)

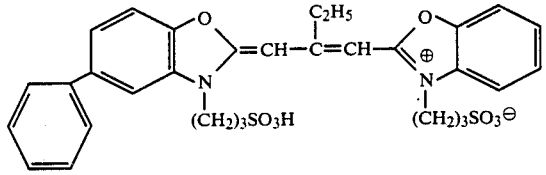

Magenta coupler (B)

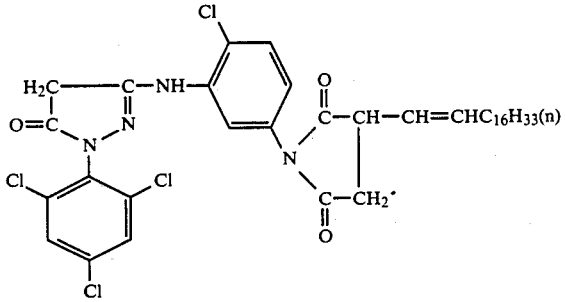

These samples were subjected to wedge-exposure, processed for 3.5 minutes with the under-mentioned color developing agent and then processed for 1.5 minutes with the under-mentioned bleach-fixing agnet. After washing with water and drying, photographic performance was measured. The results are shown in Table 1.

Further, sample was stored over 1 week under conditions of 50° C. and a relative humidity of 20%. Then, sample was exposed, color developed as mentioned above and photographic performance was also measured. The results are shown in Table 1.

Composition of color developing agent:

| | |
|---|---|
| N—Ethyl-N—β-methanesulfonamidoethyl-3-methyl-4-aminoaniline.sulfate | 4.0 g |
| Hydroxylamine.sulfate | 2.0 g |
| Potassium carbonate | 25 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (Average polymerization degree 400) | 3.0 ml |

Make up to 1 liter with the addition of water and adjust to pH 10.0 by using sodium hydroxide.

Composition of Bleach-fixing agent:

| | |
|---|---|
| Ethylenediaminetetraacetic acid iron sodium salt | 60.0 g |
| Ammonium thiosulfate | 100.0 g |
| Sodium bisulfite | 20.0 g |
| Sodium methabisulfite | 5.0 g |
| Make up to 1 liter with the addition of water and adjust to pH 7.0 by using sulfuric acid. | |
| Redox potential: | 70 mV |

TABLE 1

| Sample No. | Silver halide emulsion | Hardening agent (Added amount: 10 mg/1 g of coated gelatin) | Photographic performances: immediately after sample prepared: Relative sensitivity | $\bar{\gamma}$ (Gradation) | $D_{min}$ (Fogging) | after storage over 1 week at 50° C. and 20% R.H.: Relative sensitivity | $\bar{\gamma}$ (Gradation) | $D_{min}$ (Fogging) |
|---|---|---|---|---|---|---|---|---|
| 1 (Comparative) | Em - 1 | Comparative compound - 1 | 100 | 5.12 | 0.03 | 102 | 4.88 | 0.16 |
| 2 (Comparative) | Em - 1 | Comparative compound - 2 | 110 | 4.78 | 0.04 | 104 | 4.90 | 0.20 |
| 3 (This invention) | Em - 1 | I - 2 | 104 | 3.35 | 0.03 | 100 | 3.32 | 0.03 |
| 4 (This invention) | Em - 1 | I - 6 | 98 | 3.48 | 0.03 | 95 | 3.53 | 0.04 |
| 5 (This invention) | Em - 1 | II - 3 | 97 | 3.62 | 0.03 | 94 | 3.57 | 0.04 |
| 6 (This invention) | Em - 1 | II - 7 | 106 | 3.29 | 0.03 | 100 | 3.33 | 0.03 |
| 7 (Comparative) | Em - 2 | I - 6 | 58 | 2.72 | 0.03 | 50 | 2.68 | 0.05 |

Comparative compound 1:

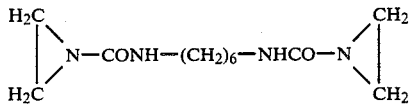

Comparative Compound 2:

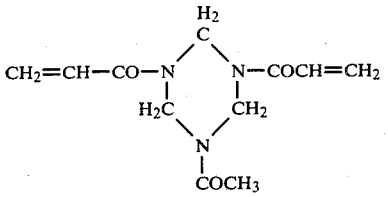

From the Table 1, it is apparent that a high sensitization can be accomplished by using a mono-dispersed emulsion. However, where other compounds than the present invention are applied, too high contrasts are obtained to be applicable to common color light-sensitive materials. Moreover, a remarkably raised fogging is produced due to storage with time. To the contrary, the present light-sensitive material shows a moderately low contrast in gradation, as compared with the Comparative Samples (Nos. 1 and 2), to give a preferable gradation and does little rise in fogging due to storage with the lapse of time.

EXAMPLE 2

As comparative emulsions, there were prepared a mono-dispersed silver chlorobromide emulsion (Em-3) composed of cubic grains and a mono-dispersed silver chlorobromide emulsion (Em-4) composed of octahedral grains and then Samples No. 8 and No. 9 were prepared in the same manner as in Example 1, preparation of Sample No. 3. By using these samples, resistance to pressure effect was tested. The test method was that each sample was immersed and wetted in pure water and then a sample surface was continuously scratched with a loaded needle with a head diameter of 0.5 mm. Then, a similar color development to Example 1 was made and the minimum load to produce fogging was measured. The results are shown in Table 2.

TABLE 2

| Sample No. | Silver halide emulsion | Hardening agent (Amount added: 10 mg/1 g of coated gelatin) | Minimum load producing fogging |
|---|---|---|---|
| 3 (This invention) | Em - 1 | I - 2 | 40 g |
| 8 (Comparative) | Em - 3 | I - 2 | 3 g |
| 9 (Comparative) | Em - 4 | I - 2 | 5 g |

Tetradecahedral grains show a remarkably superior resistance to pressure effect in the presence of the present compound, as compared with octahedral or cubic grains.

EXAMPLE 3

By using the mono-dispersed emulsion composed of tetradecahedral grains as prepared in Example 1, there were prepared a blue-sensitive emulsion (Em-5) and a red-sensitive emulsion (Em-6).

Further, color light-sensitive materials were prepared by coating in turn the following layers onto a resin-coated paper support, wherein an added amount of the respective compounds was per 100 $cm^2$ of a color light-sensitive material.

First layer; a blue-sensitive silver halide emulsion layer having the under-mentioned yellow coupler C (7.8 mg) and the Em-5 (3.5 mg in terms of silver) and 20 mg of gelatin.

Second layer; an intermediate layer having 0.2 mg of dioctylhydroquinone and 10 mg of gelatin.

Third layer; a green-sensitive silver halide emulsion layer having the above-mentioned magenta coupler B (4.2 mg) and the Em-1 (3.5 mg in terms of silver) and 20 mg of gelatin.

Fourth layer; an intermediate layer having 0.3 mg of dioctylhydroquinone, 8 mg of an ultraviolet rays absorbing agent and 15 mg of gelatin.

Fifth layer; a red-sensitive silver halide emulsion layer having the under-mentioned cyan coupler D (3.0 mg) and the Em-6 (2.5 mg in terms of silver) and 15 mg of gelatin.

Sixth layer; an intermediate layer having 4.0 mg of an ultraviolet rays absorbing agent and 10 mg of gelatin.

Seventh layer; a protective layer containing 10 mg of gelatin.

Samples No. 10 and No. 11 were prepared by incorporating 1 mg/$dm^2$ of the exemplary compound I-3 and 1 mg/$dm^2$ of the comparative compound 1 disclosed in Example 1 into the light-sensitive material. These samples were evaluated according to the method disclosed in Example 1. Table 3 shows gradation ($\gamma$) and increased $D_{min}$ (fogging) due to storage with the lapse of time.

TABLE 3

| Sample No. | Gradation $\bar{\gamma}$ | | | Increase in fogging due to storage with the lapse of time | | |
|---|---|---|---|---|---|---|
| | B | G | R | B | G | R |
| 10 (This invention) | 3.11 | 3.45 | 3.70 | +0.02 | 0 | +0.01 |
| 11 (Comparative) | 4.36 | 5.12 | 4.98 | +0.09 | +0.15 | +0.08 |

Even in laminated samples, every layer becomes moderately soft by effect of the present invention and suitable gradation can be obtained as a color photographic paper. Also, increase in fogging is reduced in every layer and, in particular, a great effect is accomplished to a green-sensitive emulsion layer.

Cyan coupler D

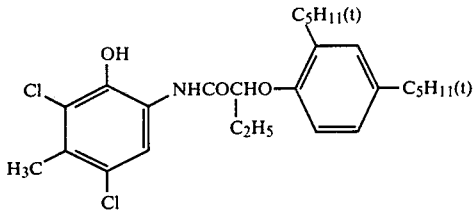

Yellow coupler C

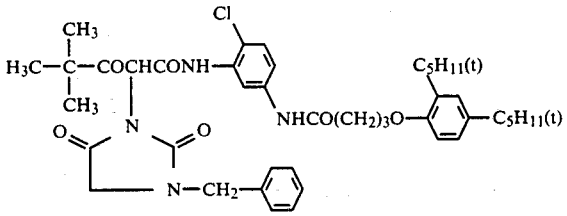

We claim:

1. A light-sensitive silver halide photographic material containing at least one layer of silver halide emulsion layers on a support characterized in that at least one layer of said silver halide emulsion layers contains silver halide grains which consist essentially of monodispersed silver halide grains having (100) faces and (111) faces, said monodispersed silver halide grains are normal crystal grains and are tetradecahedral, and said silver halide emulsion layer is hardened with (i) at least one of the hardening agents represented by the following formula (I) or (ii) at least one of the hardening agents represented by the following formula (II) or mixtures of (i) and (ii),

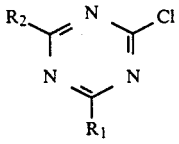

wherein $R_1$ represents a chlorine atom, a hydroxy group, an alkyl group, an alkoxy group, an alkylthio group, —OM group wherein M is a monovalent metal atom, —NR'R" wherein R' and R" are a hydrogen atom, an alkyl group or an aryl group, respectively, or —NHCOR'" wherein R'" is a hydrogen atom, an alkyl group or an aryl group and $R_2$ has the same meanings as $R_1$ except it does not represent a chlorine atom,

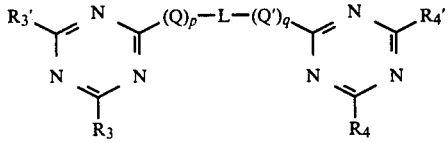

wherein $R_3$, $R_3'$, $R_4$ and $R_4'$ each represent a chlorine atom, a hydroxy group, an alkyl group, an alkoxy group or a —OM group wherein M is a monovalent metal atom; Q and Q' each represent a binding group of —O—, —S— or —NH—; L represents an alkylene group or an arylene group; and p and q each represent 0 or 1.

2. The light-sensitive silver halide photographic material according to claim 1, wherein said mono-dispersed silver halide grain has a silver halide composition of not less than 5 mole % of silver chloride, not more than 1 mole % of silver iodide and the remainder of silver bromide.

3. The light-sensitive silver halide photographic material according to claim 2, wherein said mono-dispersed silver halide grain has a silver halide composition of not less than 15 mole % of silver chloride.

4. The light-sensitive silver halide photographic material according to claim 1, wherein the coefficient of variation of the silver halide grains is not more than 22% when the coefficient of variation is defined by the following formula:

$$\text{Coefficient of variation} = \frac{\text{Standard deviation of grain diameter}}{\text{Average grain diameter}} \times 100(\%).$$

5. The light-sensitive silver halide photographic material according to claim 4, wherein the coefficient of variation of the silver halide grains is 15% or less.

6. The light-sensitive silver halide photographic material according to claim 1, wherein said mono-dispersed silver halide grains satisfy the relation of $3 \leqq K \leqq 500$ when K is defined by the following formula:

$$K = \frac{\text{Intensity of diffracted ray attributable to (200) face}}{\text{Intensity of diffracted ray attributable to (222) face}}.$$

7. The light-sensitive silver halide photographic material according to claim 6, wherein said mono-dispersed silver halide grains satisfy the relation of $10 \leqq K \leqq 400$.

8. The light-sensitive silver halide photographic material according to claim 1, wherein said mono-dispersed silver halide grains satisfy the relation of $40 \leqq K \leqq 200$.

9. The light-sensitive silver halide photographic material according to claim 1, wherein the range of an average grain size of said mono-dispersed silver halide grains is from 0.2 to 2.0 μm.

10. The light-sensitive silver halide photographic material according to claim 1, wherein said material further contains a magenta coupler represented by the following formula [III]:

[III]

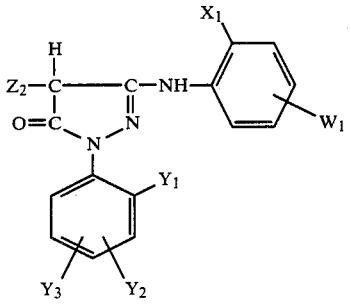

wherein $X_1$ represents a hydrogen atom, a halogen atom, an alkyl group, an alkoxy group, an aryloxy group, an amido group, a hydroxy group, a cyano group or a nitro group; $Y_1$, $Y_2$ and $Y_3$ individually represent a hydrogen atom, a halogen atom, an alkyl group, an alkoxy group, a carboxy group, an alkoxycarbonyl group, a nitro group, an aryloxy group, a cyano group or an acylamino group; $W_1$ represents a hydrogen atom, a halogen atom or a monovalent organic group; and $Z_2$ represents atoms or groups which are removable by coupling reaction.

11. The light-sensitive silver halide photographic material according to claim 2, wherein the coefficient of variation of the silver halide grains is not more than 22% when the coefficient of variation is defined by the following formula:

$$\text{Coefficient of variation} = \frac{\text{Standard deviation of grain diameter}}{\text{Average grain diameter}} \times 100(\%),$$

said mono-dispersed silver halide grains satisfy the relation of $3 \leqq K \leqq 500$ when K is defined by the following formula:

$$K = \frac{\text{intensity of diffracted ray attributable to (200) face}}{\text{Intensity of diffracted ray attributable to (222) face}}, \text{ and}$$

the range of an average grain size of said mono-dispersed silver halide grains is from 0.2 to 2.0 μm.

12. The light-sensitive silver halide photographic material according to claim 11, wherein said mono-dispersed silver halide grain has a silver halide composition of not less than 15 mole % of silver chloride, said coefficient of variation of the silver halide grains is 15% or less, and said mono-dispersed silver halide grains satisfy the relation of $10 \leqq K \leqq 400$.

13. The light-sensitive silver halide photographic material according to claim 12, wherein said mono-dispersed silver halide grains satisfy the relation of $40 \leqq K \leqq 200$.

14. The light-sensitive silver halide photographic material according to claim 11, wherein said material further contains a magenta coupler represented by the following formula (III):

[III]

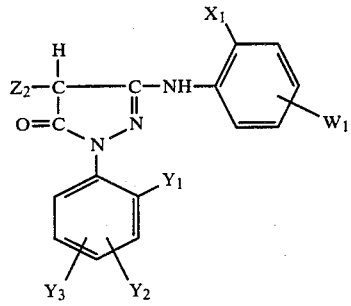

wherein $X_1$ represents a hydrogen atom, a halogen atom, an alkyl group, an alkoxy group, an aryloxy group, an amido group, a hydroxy group, a cyano group or a nitro group; $Y_1$, $Y_2$ and $Y_3$ individually represent a hydrogen atom, a halogen atom, an alkyl group, an alkoxy group, a carboxy group, an alkoxycarbonyl group, a nitro group, an aryloxy group, a cyano group or an acylamino group; $W_1$ represents a hydrogen atom, a halogen atom or a monovalent organic group; and $Z_2$ represents atoms or groups which are removable by coupling reaction.

15. The light-sensitive silver halide photographic material according to claim 12, wherein said material further contains a magenta coupler represented by the following formula (III):

[III]

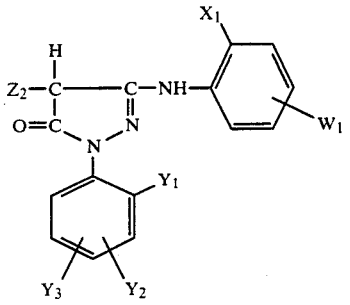

wherein $X_1$ represents a hydrogen atom, a halogen atom, an alkyl group, an alkoxy group, an aryloxy group, an amido group, a hydroxy group, a cyano group or a nitro group; $Y_1$, $Y_2$ and $Y_3$ individually represent a hydrogen atom, a halogen atom, an alkyl group, an alkoxy group, a carboxy group, an alkoxycarbonyl group, a nitro group, an aryloxy group, a cyano group or an acylamino group; $W_1$ represents a hydrogen atom, a halogen atom or a monovalent organic group; and $Z_2$ represents atoms or groups which are removable by coupling reaction.

16. The light-sensitive silver halide photographic material according to claim 15, wherein said magenta coupler is:

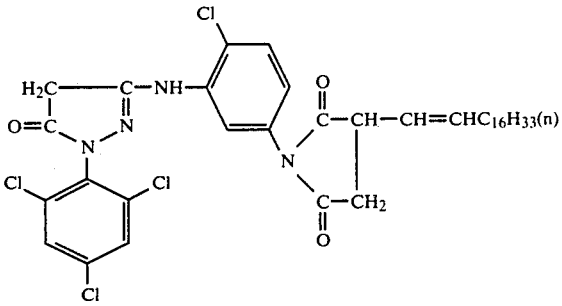

17. The light-sensitive silver halide photographic material according to claim 16, wherein said mono-dispersed silver halide grains satisfy the relation of $10 \leqq K \leqq 400$.

18. The light-sensitive silver halide photographic material according to claim 10, wherein said magenta coupler is:

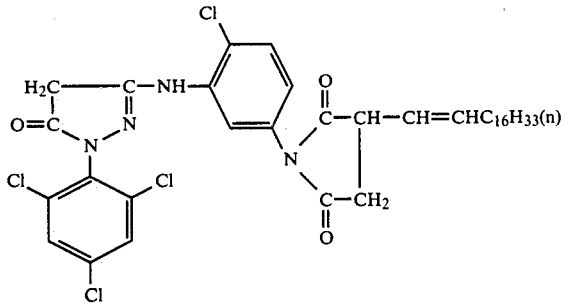

* * * * *